US011235908B2

(12) United States Patent
Yockey

(10) Patent No.: US 11,235,908 B2
(45) Date of Patent: Feb. 1, 2022

(54) COMPACT CONTAINER

(71) Applicant: Mantis Product Development Corp., Pinckney, MI (US)

(72) Inventor: Steve John Yockey, Ann Arbor, MI (US)

(73) Assignee: MANTIS PRODUCT DEVELOPMENT CORP., Pinckney, MI (US)

( * ) Notice: Subject to any disclaimer, the term of this patent is extended or adjusted under 35 U.S.C. 154(b) by 186 days.

(21) Appl. No.: 15/868,350

(22) Filed: Jan. 11, 2018

(65) Prior Publication Data

US 2018/0215508 A1 Aug. 2, 2018

Related U.S. Application Data

(60) Provisional application No. 62/499,524, filed on Jan. 30, 2017.

(51) Int. Cl.

| | |
|---|---|
| ***B65D 25/20*** | (2006.01) |
| ***B65D 25/28*** | (2006.01) |
| ***B65D 43/22*** | (2006.01) |
| ***B65D 81/38*** | (2006.01) |
| ***B65D 43/16*** | (2006.01) |

(Continued)

(52) U.S. Cl.

CPC ..... *B65D 25/20* (2013.01); *A45C 11/00* (2013.01); *A45C 11/20* (2013.01); *A45C 13/18* (2013.01); *B65D 25/2867* (2013.01); *B65D 43/16* (2013.01); *B65D 43/22* (2013.01);

(Continued)

(58) Field of Classification Search

CPC .... A45C 11/00; B65D 25/20; B65D 25/2867; B65D 43/16; B65D 43/22; B65D 81/3816; B65D 81/3818; B65D 81/3823

USPC ..... 224/274; 220/592.03, 760, 759, 912.2, 220/915.1

See application file for complete search history.

(56) References Cited

U.S. PATENT DOCUMENTS

| | | | | |
|---|---|---|---|---|
| 3,640,420 A * | 2/1972 | Carter | ..... | A45C 13/26 220/592.2 |
| 4,458,826 A * | 7/1984 | Mu-Jung | ..... | B65D 43/14 220/811 |

(Continued)

*Primary Examiner* — Nathan J Newhouse
*Assistant Examiner* — Lester L Vanterpool
(74) *Attorney, Agent, or Firm* — Hoffmann and Baron, LLP

(57) ABSTRACT

The invention, a compact container for mounting to a golf cart, has a box like body with an open top end and a pocket in the back wall that cooperates with a bracket mounted to a golf cart for selectively supporting the container. The invention includes a cover having a flat top wall and a pair of opposing side flaps that extend over the side walls of the body to form a pivotal connection for movement about a first axis of rotation between a closed and an opened position of the container. A U-shaped handle extends over opposing side walls of the body to form a pivotal connection along a second axis of rotation for movement between a raised position and a stowed position of the handle. The first axis is disposed approximately halfway between the second axis and the back wall of the container wherein the top wall of the cover, in the opened position, is flush with, and substantially overlaps, the back wall of the body. Thus, the clearance required for the container is minimized for mounting within the restricted space available on a golf cart.

19 Claims, 6 Drawing Sheets

(51) Int. Cl.
*A45C 11/00* (2006.01)
*A45C 11/20* (2006.01)
*A45C 13/18* (2006.01)

(52) U.S. Cl.
CPC ..... *B65D 81/3816* (2013.01); *B65D 81/3818* (2013.01); *B65D 81/3823* (2013.01)

(56) References Cited

U.S. PATENT DOCUMENTS 4,592,482 A * 6/1986 Seager ..... A45C 11/20 220/318
4,889,257 A * 12/1989 Steffes ..... A45C 5/00 220/815
4,981,019 A * 1/1991 Hicks ..... F25B 27/007 62/3.62
4,989,767 A * 2/1991 Buschbom ..... B60N 3/103 224/274
5,165,645 A * 11/1992 Brown ..... B60N 3/103 248/310
5,169,018 A * 12/1992 Fiore ..... A45C 7/0045 206/315.11
5,226,553 A * 7/1993 Fiore ..... A45C 7/0045 206/315.11
5,259,215 A * 11/1993 Rocca ..... A45C 5/143 280/30
5,366,106 A * 11/1994 Kahl ..... A45C 11/20 206/549
D359,658 S * 6/1995 Cook ..... D7/605
5,823,337 A * 10/1998 Yunger ..... A01K 97/06 206/315.11
5,893,478 A * 4/1999 Maruoka ..... E05B 83/32 220/827
6,446,382 B1 * 9/2002 Cloutier ..... A01K 97/06 43/54.1
7,044,344 B2 * 5/2006 Winkler ..... A63B 71/00 224/274
7,066,363 B2 * 6/2006 Lecoq ..... B60N 3/10 224/274
7,246,718 B2 * 7/2007 Einav ..... B25H 3/02 220/764
8,016,153 B2 * 9/2011 Boenig ..... A45C 13/26 220/847
8,356,712 B2 * 1/2013 Piazza, Jr. ..... A45C 9/00 206/545
9,341,403 B2 * 5/2016 Conrad ..... A45C 15/00
9,469,024 B2 * 10/2016 Bensman ..... B65D 25/28
2003/0010786 A1 * 1/2003 Sambonmatsu ..... B60N 3/10 220/737
2006/0144841 A1 * 7/2006 Sener ..... A45C 11/20 220/521
2006/0213206 A1 * 9/2006 Linder ..... F25B 21/02 62/3.6
2008/0190914 A1 * 8/2008 Gibson ..... A47J 39/006 219/689
2008/0217342 A1 * 9/2008 Cinque ..... B62B 3/1464 220/592.2
2010/0005827 A1 * 1/2010 Winkler ..... F25D 3/08 62/457.2
2015/0217926 A1 * 8/2015 Meether ..... B65D 81/3813 220/592.2

* cited by examiner

COMPACT CONTAINER

CROSS-REFERENCE TO RELATED APPLICATIONS

This application claims priority to U.S. Provisional Application Ser. No. 62/499,524 filed on Jan. 30, 2017, the disclosure of which is incorporated herein by reference.

FIELD OF THE INVENTION

The present invention generally relates to a storage container and, more specifically, to a compact storage container for mounting on a vehicle such as a golf cart.

BACKGROUND

Golf course owners commonly offer small four-wheel electric golf carts to their customers for transportation during a round of golf. Golf carts generally have a small, lightweight body including a small hooded section over the front wheels, an open passenger compartment, and an open storage area between the rear wheels for securing golf club bags. Two or more narrow struts extend up from the body to support a roof panel for sheltering the passengers and their bags.

For added convenience of the golfers, carts are often fitted with various accessories for use during a round of golf. The most popular accessories are containers such as insulated coolers for cold beverages and sand buckets for dry storage of sand and seed mix for divot repair. Containers and other accessories are commonly supported by a basket or bracket mounted at the side of the cart near the bag storage area where they do not impede driving visibility and are immediately accessible to passengers upon exiting the cart.

As shown in FIG. 12, one conventional prior art container structure includes a box-shaped body, a handle pivotally connected to the body at the side walls, and a flat cover pivotally connected to the body at the back wall. This design, while adequate for general use containers, has proven to be problematic on golf cart applications. Golf carts generally have very little space for mounting accessories, and some models include containers that cannot be fully opened because of an obstruction with a cart component or another accessory, and this prevents convenient access to the container contents. Furthermore, the body/cover connection typically has a snap fit configuration that has proven susceptible to vibration failure on golf cart applications resulting in covers becoming detached and lost.

As shown in FIG. 13, another prior container structure, introduced by Igloo under the brand name Playmate, includes an integral cover and handle that is connected to the body on the vertical centerline of opposing side walls so as to rotate rearward, upon opening, to fully overlap the back wall of the container. Although the side wall connections are less prone to vibration failure, this design is not practical for mounting on a golf cart since the cover, in the open position, would interfere with the mounting bracket and supporting cart structure. Furthermore, the shape of the cover prevents efficient stacking of containers for storage and this is problematic for golf course operators who typically have limited space for inventory.

Thus, there is a need for a more robust and space-efficient container for mounting to a golf cart.

SUMMARY

The invention, a compact container for mounting to a golf cart, has a box like body with an open top end and a pocket in the back wall that cooperates with a bracket mounted to a golf cart for selectively supporting the container. The invention includes a cover having a flat top wall and a pair of opposing side flaps that extend over the side walls of the body to form a pivotal connection for movement about a first axis of rotation between a closed and an opened position of the container. A U-shaped handle extends over opposing side walls of the body to form a pivotal connection along a second axis of rotation for movement between a raised position and a stowed position of the handle. The first axis is disposed approximately halfway between the second axis and the back wall of the container wherein the top wall of the cover, in the opened position, is flush with, and substantially overlaps, the back wall of the body. Thus, the clearance required for the container is minimized for mounting within the restricted space available on a golf cart.

Accordingly several objects and advantages of the invention are to provide a more space-efficient container, to provide improved access to the container, to provide a more secure connection of the cover, to provide a more secure means for mounting the container, and to provide a more user-friendly, yet economical, container. Still further objects and advantages will become apparent from a study of the following description and the accompanying drawings.

BRIEF DESCRIPTION OF THE FIGURES

The preferred embodiments of the compact container for mounting to a golf cart, as well as other objects, features and advantages of this invention, will be apparent from the accompanying drawings wherein.

DETAILED DESCRIPTION

Figure 1:
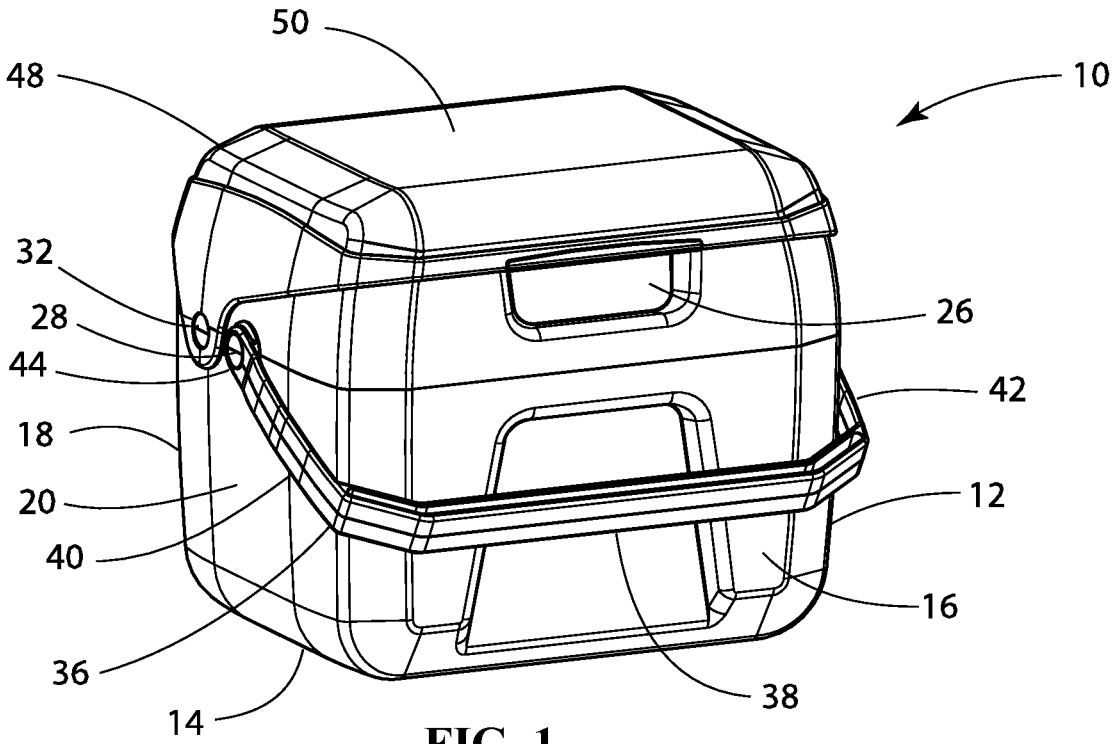
FIG. 1 is a front perspective view of the compact storage container of the present invention in the closed position.
Figure 2:
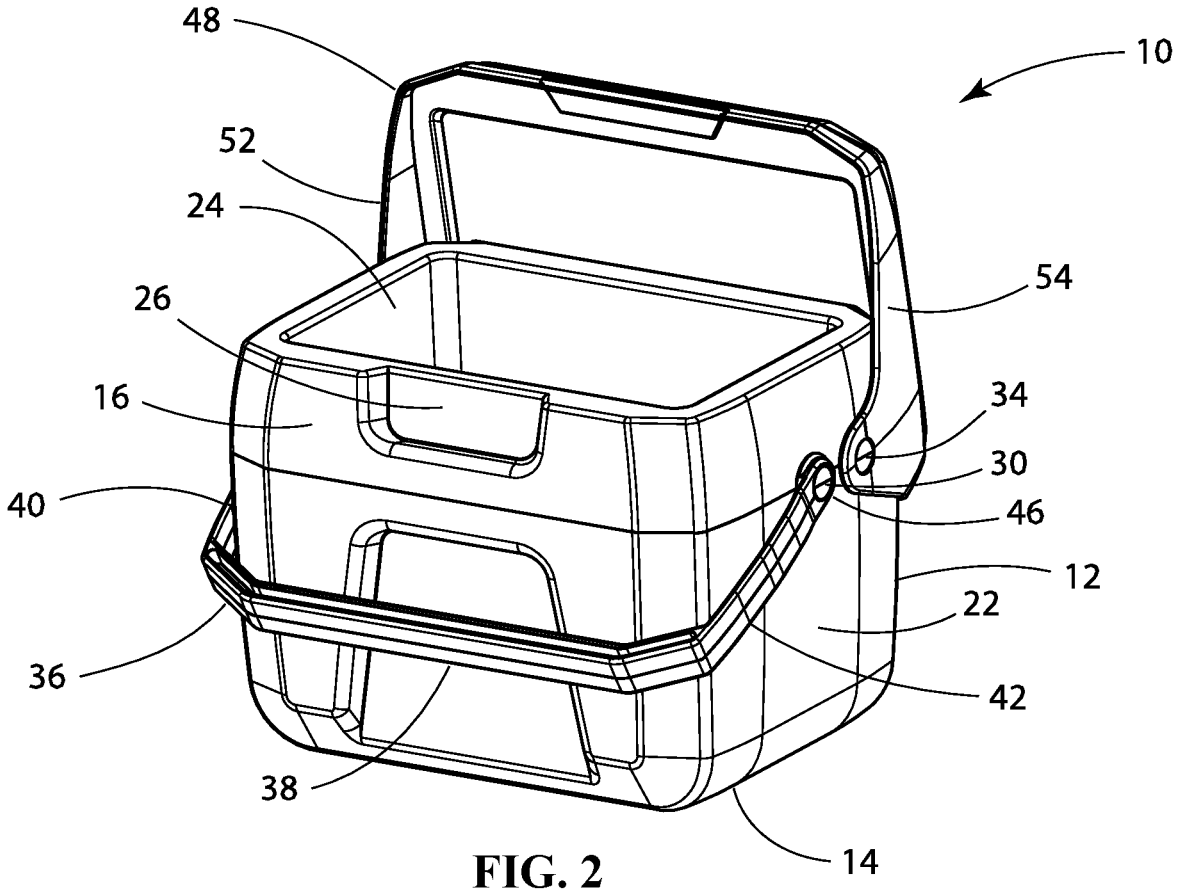
FIG. 2 is a front perspective view of the container in the open position.

Referring to FIGS. 1-7, the storage container 10 comprises a box like body 12 having a substantially flat bottom wall 14, a front wall 16, a back wall 18, a first side wall 20, a second side wall 22, and an open top end 24. An indentation 26 is preferably formed in the exterior surface of front wall 16 adjacent to open top end 24. A pair of opposing cylindrical center posts 28, 30 extend from the exterior surface of first and second side walls 20, 22, respectively, along a common axis approximately equidistant from front wall 16 and back wall 18. A pair of opposing cylindrical offset posts 32, 34 extends from the exterior surface of first and second side walls 20, 22, respectively, along a common axis approximately equidistant from open top end 24 and back wall 18. Center posts 28, 30 and offset posts 32, 34 are located about the same distance below open top end 24.

Storage container 10 further comprises a U-shaped handle 36 having an elongate grip 38 and a pair of legs 40, 42. A pair of handle holes 44, 46, disposed at the distal end of legs 40, 42, respectively, form a pivotal connection with center posts 28, 30, respectively, for movement of handle 36 between a stowed position (shown in FIG. 1) and a raised position (shown in FIG. 5).

Storage container 10 further comprises a cover 48 having a substantially flat top wall 50 adapted to substantially enclose open top end 24 of container body 12. A pair of flaps 52, 54 extend from top wall 50 at opposing ends thereof to overlap first and second side walls 20, 22, respectively. A pair of cover holes 56, 58, disposed at the distal end of flaps 52, 54, respectively, form a pivotal connection with offset posts 32, 34, respectively, for movement of cover 48 between a closed position (shown in FIG. 1) and an opened position (shown in FIG. 2).

Figure 3:
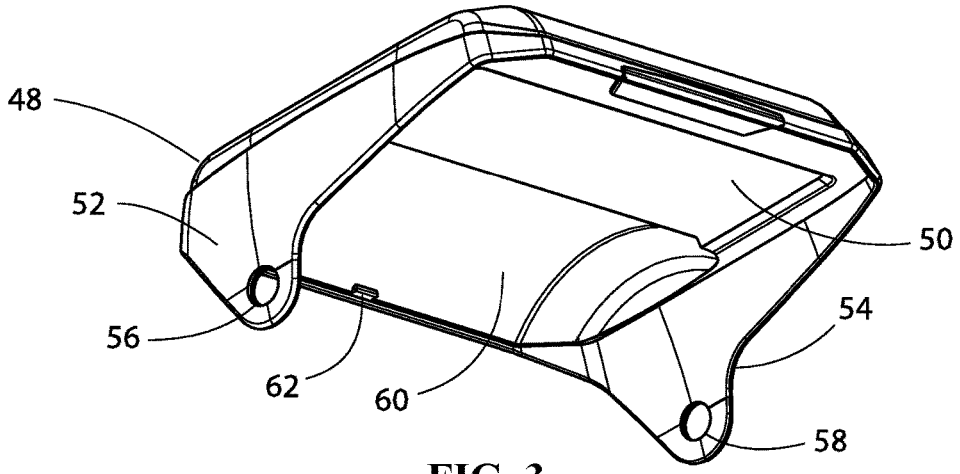
FIG. 3 is a perspective view of the cover only.
Figure 4:
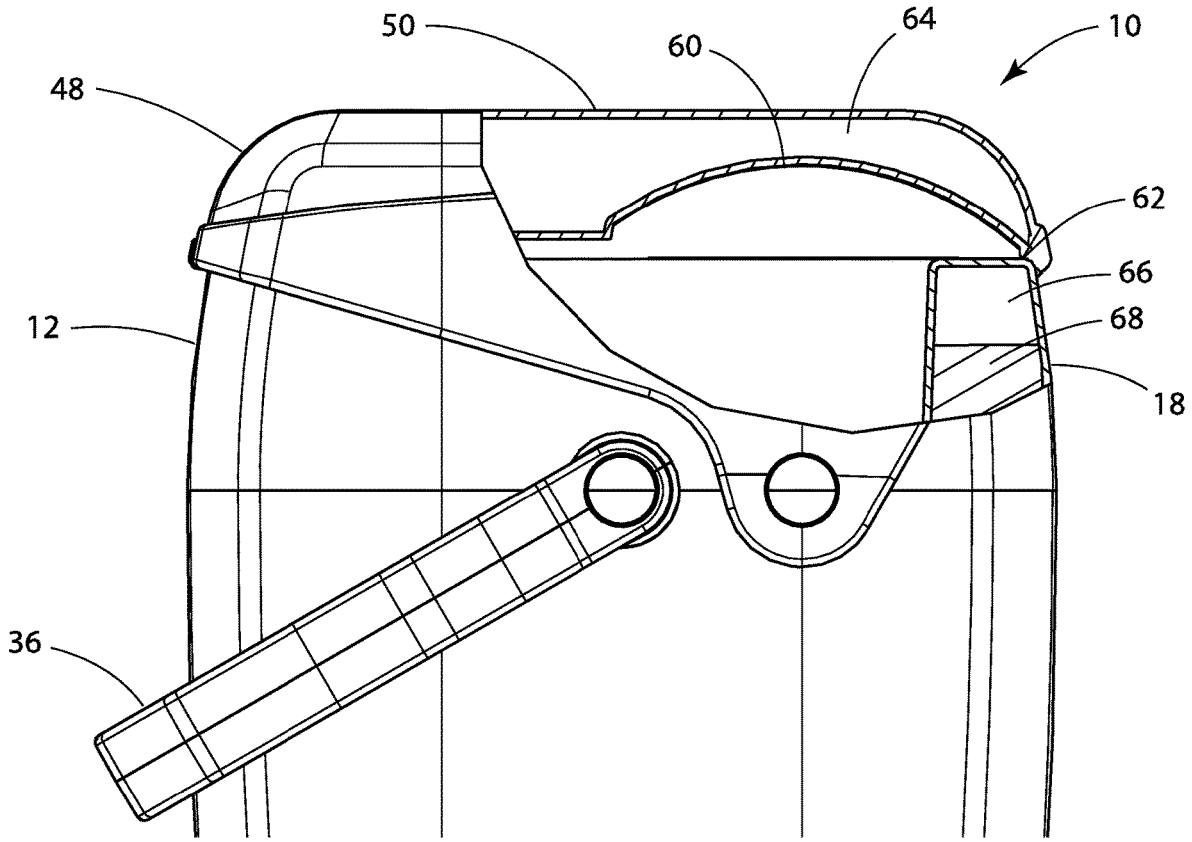
FIG. 4 is a partial side view of the container that includes a partial cross section for illustrating the internal cavities of the body and cover.

Referring to FIGS. 3 and 4, cover 48 includes a semi-cylindrical recess 60 extending along the bottom surface of top wall 50 between flaps 52, 54. Recess 60 is adapted to provide clearance between back wall 18 and top wall 50 during operation of cover 48 between the opened position and closed position of container 10. In this illustrated, exemplary embodiment, cover 48 includes a protrusion 62 extending from the bottom surface of recess 60 approximately halfway between flaps 52, 54 to communicate with the top of back wall 18 in the closed position of container 10 as a detent for resisting the unintended opening of container 10. In alternative embodiments, a detent could comprise other features such as, for example, a notch or groove, as well as additional elements typically used for securing container covers such as, for example, a spring or a magnet. Furthermore, a detent could be disposed at an alternate location such as, for example, at the interface of top wall 50 and front wall 16, or at the interface of side walls 20, 22 and flaps 52, 54, respectively.

Figure 5:
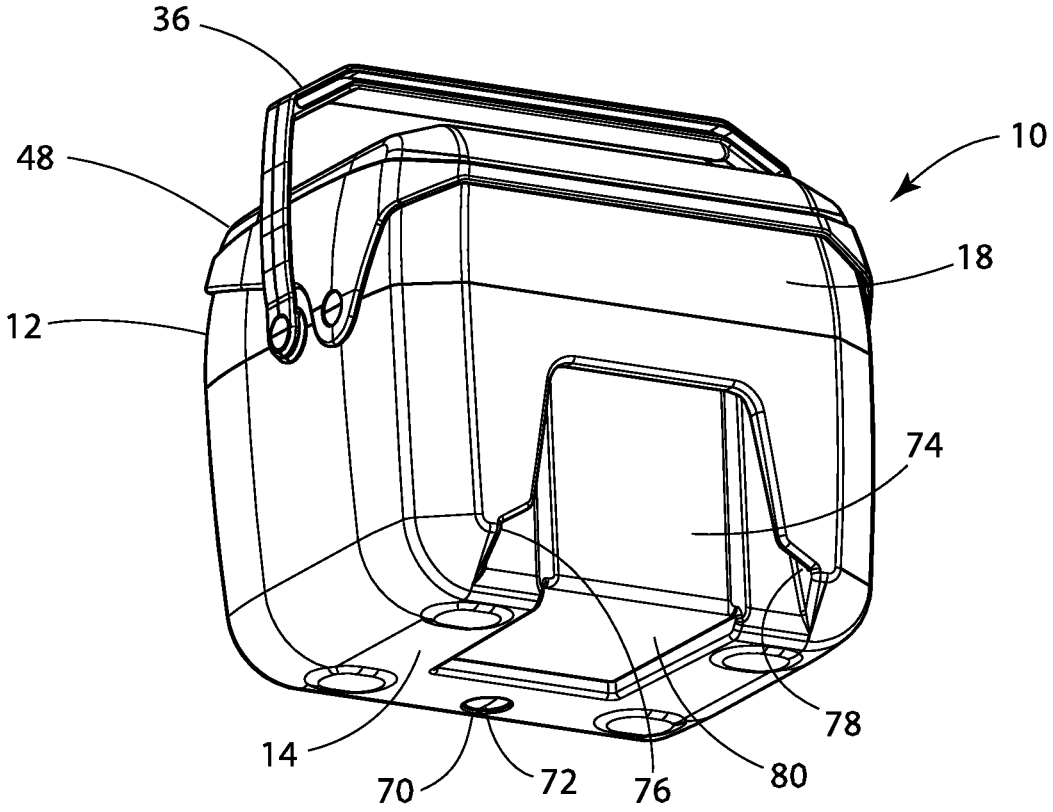
FIG. 5 is a rear perspective view of the container with raised handle.
Figure 6:
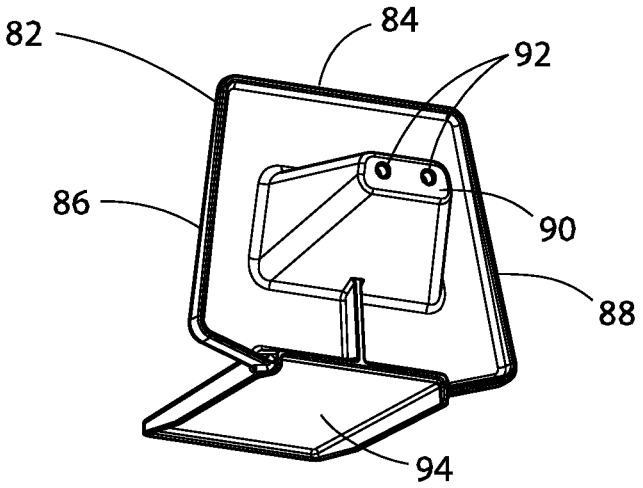
FIG. 6 is a rear perspective view of the mounting bracket of the present invention.
Figure 7:
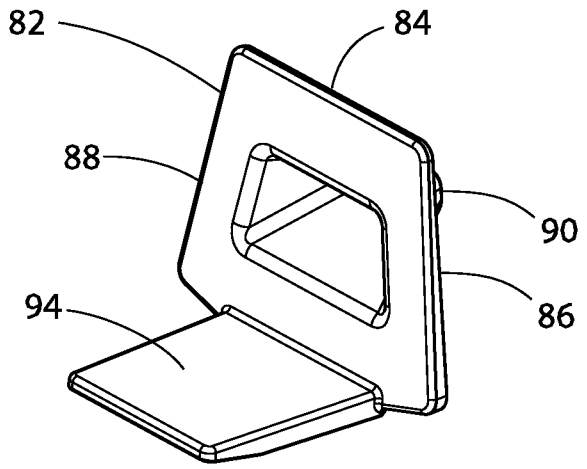
FIG. 7 is a front perspective view of the mounting bracket.

Referring to FIGS. 4 and 5, the present embodiment of container 10 is made of any durable thermoplastic material such as polypropylene and preferably includes double wall construction defining an internal cover channel 64 within top wall 50 of cover 48, and an internal body channel 66 extending within container body 12. Body channel 66 is substantially filled with insulation 68 such as an expanded polyurethane foam that is injected while in liquid form through an aperture 70 in bottom wall 14 whereupon insulation 68 expands and solidifies. Bottom wall 14 includes a locking plug 72 inserted into aperture 70 after injection of insulation 68 for sealing body channel 66. Cover channel 64 may also be filled with insulation, if desired.

Referring now to FIGS. 5-8, back wall 18 of container 10 includes a trapezoidal pocket 74 that extends to bottom wall 14 having a pair of grooved sidewalls 76, 78 disposed at an internal angle of approximately twenty degrees. Bottom wall 14 includes a substantially rectangular depression 80 that extends to back wall 18. Pocket 74 and depression 80 are designed to cooperate with an L-shaped bracket 82, preferably constructed of cast aluminum, for selectively supporting storage container 10. Bracket 82 preferably includes a vertical trapezoidal blade 84 having a first tapered side edge 86 and a second tapered side edge 88 adapted to engage grooved sidewalls 76, 78, respectively. Blade 84 includes an offset wall 90 having a plurality of apertures 92 suitable for accepting a corresponding plurality of fasteners (not shown). A rectangular base 94 extends horizontally from blade 84 at the bottom edge thereof adapted to engage depression 80 for providing supplemental support of container 10.

Figure 8:
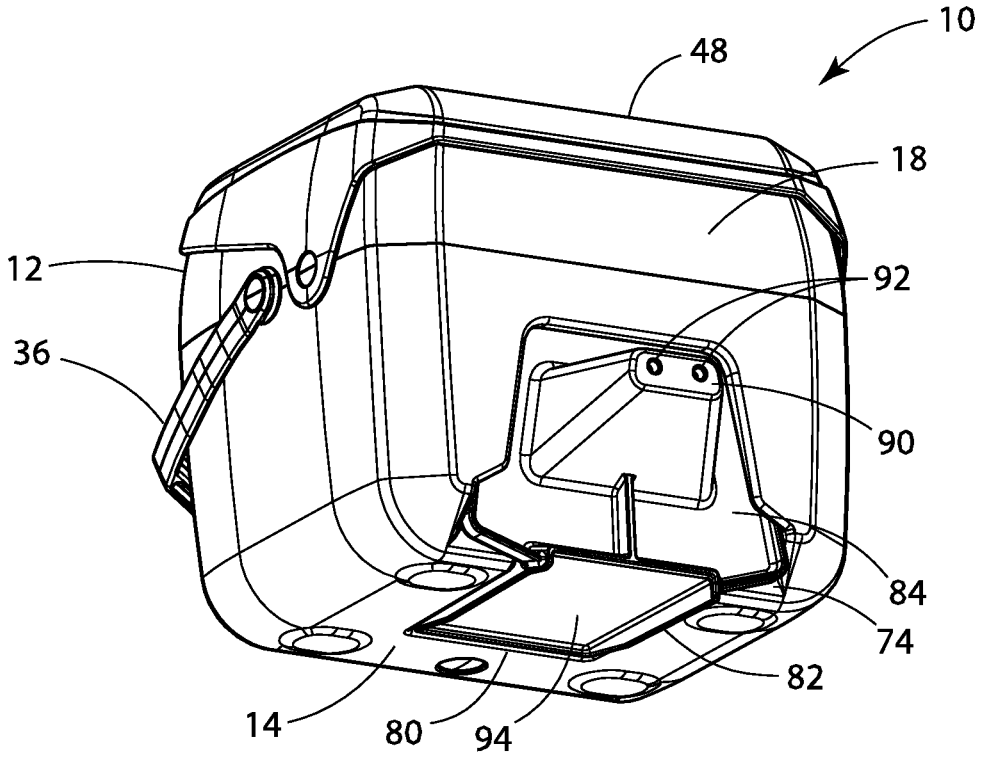
FIG. 8 is a perspective view of the container and bracket assembly.
Figure 9:
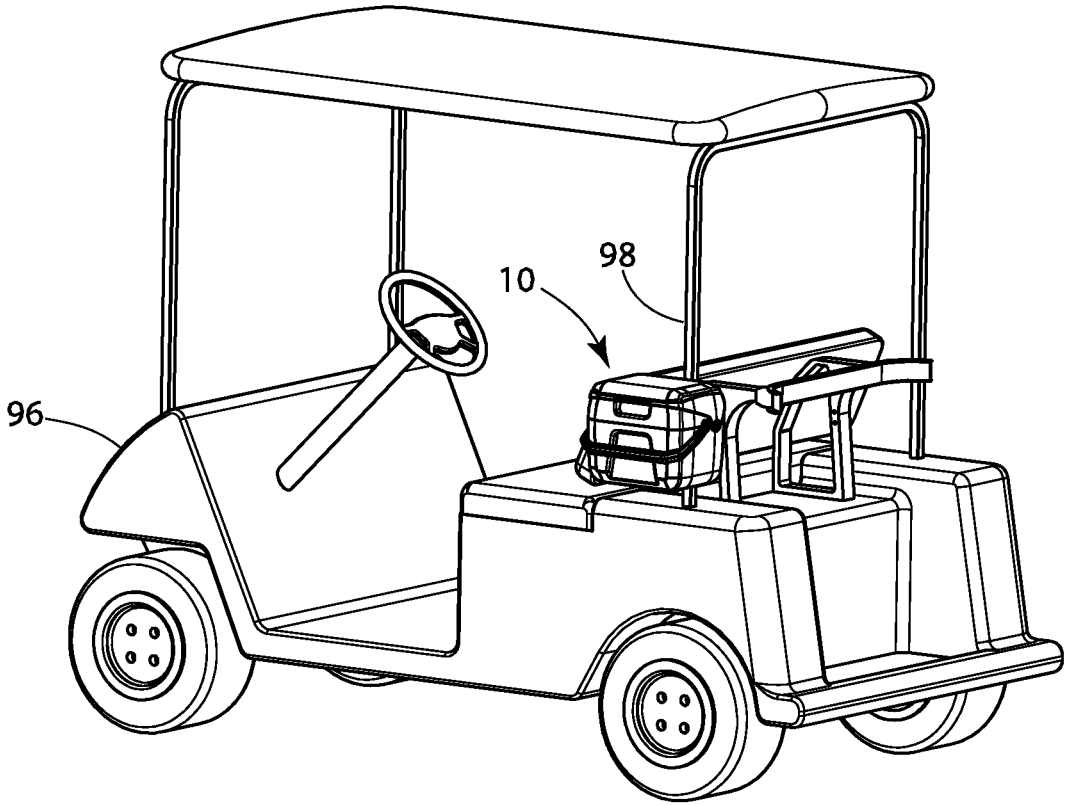
FIG. 9 is a perspective view showing the container mounted to a golf cart.
Figure 10:
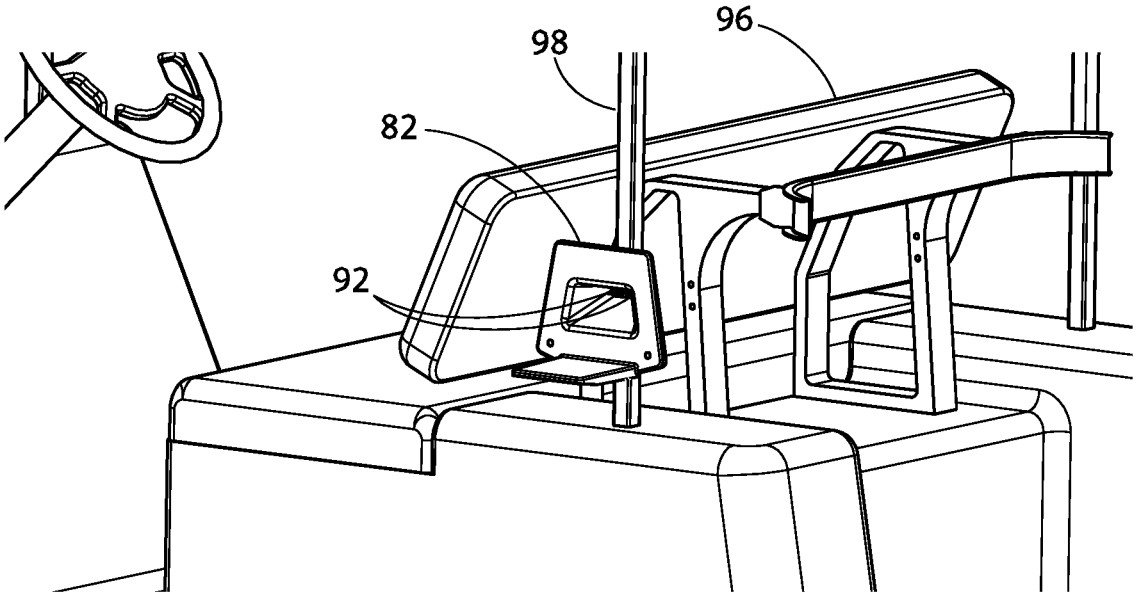
FIG. 10 is a partial perspective view showing the bracket mounted to the roof support structure of a golf cart.

Referring to FIGS. 8-10, bracket 82 can be mounted to a golf cart 96 by securing screws (not shown) through apertures 92 to a structural support 98 of golf cart 96. The present compact storage container 10 may be mounted to golf cart 96 by lowering body 12 onto bracket 82 until tapered edges 86, 88 have fully engaged grooved side walls 76, 78, respectively, and base 94 engages depression 80. The predetermined included angle of grooved side walls 76, 78 enables engagement and disengagement of container 10 and bracket 82 without need of precise prealignment or excessive force.

Figure 11:
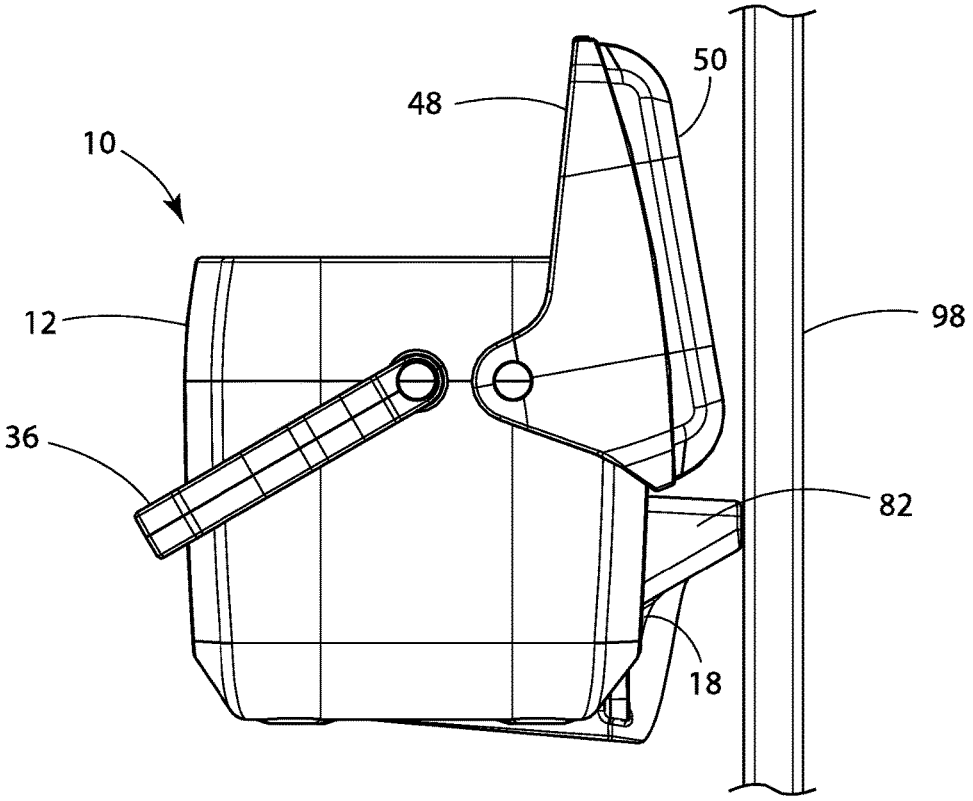
FIG. 11 is a partial side view of the mounted container of FIG. 9 in the open position.
Figure 12:
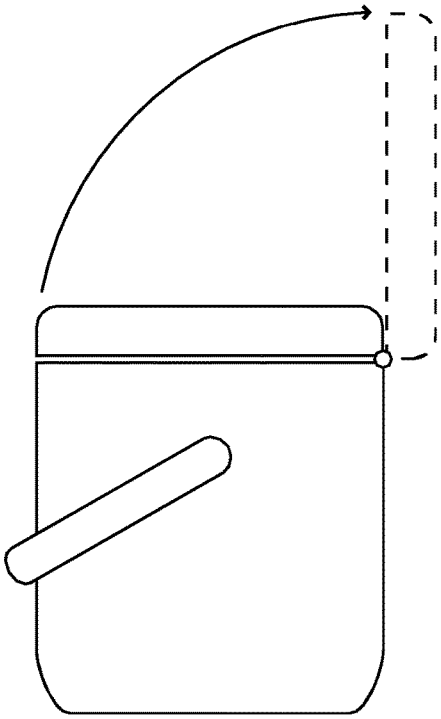
FIG. 12 (PRIOR ART)
FIG. 12 is a diagrammatic side view of a prior art container having a cover hinged to the body back wall. The arrow and dashed lines illustrate operation of the cover.
Figure 13:
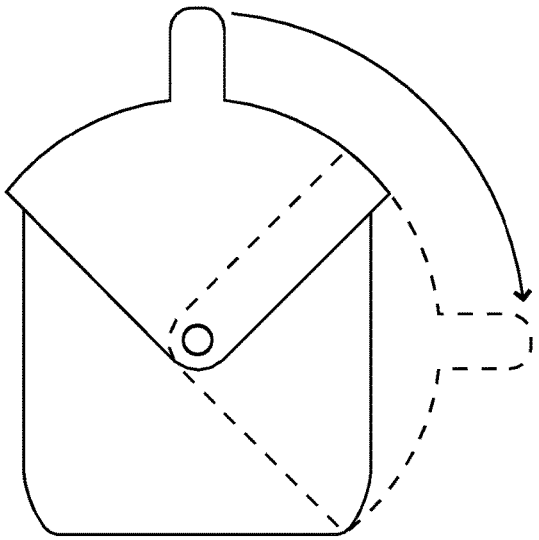
FIG. 13 (PRIOR ART)
FIG. 13 is a diagrammatic side view of a prior art container having a cover connected at the vertical centerline of the body side walls. The arrow and dashed lines illustrate operation of the cover.

Those skilled in the art will recognize several advantages of the present compact container over the aforementioned prior art. Referring to FIGS. 1-4, the connections of flaps 52, 54 and posts 32, 34 prevent vibrational forces from causing detachment of cover 48 from body 12. Furthermore, container 10 may be conveniently opened by applying an upward force to cover 48 at indentation 26 sufficient to overcome the detent force of protrusion 62 causing cover 48 to rotate about offset posts 32, 34. Referring now to FIG. 11, cover top wall 50, in the fully opened position of container 10, is adjacent to, and partially overlaps, back wall 18, for minimizing the clearance required for operation of cover 48 while avoiding interference with bracket 82 and supporting cart structure. Still furthermore, top wall 50 is flat for minimizing the size of container 10 and for enabling container 10 to be stacked in storage. Thus, container 10 can be mounted on a golf cart for providing secure storage and convenient access, and can be easily removed from the cart and efficiently stored.

Although the present storage container is described in the context of a golf cart, it may be readily adapted for various applications such as, for example, a jeep, motorcycle, or boat. Thus, while there have been described the preferred embodiments of the present invention, those skilled in the art will realize that other embodiments can be made without departing from the spirit of the invention, and it is intended to include all such further modifications and changes as come within the true scope of the claims set forth herein.

While the present disclosure has been described with reference to one or more exemplary embodiments, it will be understood by those skilled in the art that various changes can be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the present disclosure.

What is claimed is:

1. A storage container for mounting on a golf cart, comprising:

a container body including a front wall, a back wall, a pair of opposing side walls, and an open top end, mounting means for selectively attaching said container body to a golf cart, a single, contiguous cover including a top wall having a planar top surface portion spaced apart from a bottom surface, the cover further including a pair of integrally formed opposing side flaps extending from said top wall, each of said flaps overlapping one of said side walls and operably connected thereon for movement about a first axis of rotation to rotate said cover over a top edge of the back wall between a closed position for enclosing said entire open top end, and an opened position for allowing access to said open top end, a handle separate from the cover and having a pair of arms operably connected to said side walls of said container body for movement about a second axis of rotation not associated with the cover, the handle rotatable about the second axis of rotation between a raised position for carrying said storage container and a stowed position for allowing access to said open top end, wherein a) said first axis is disposed between said second axis and said back wall, and b) in said opened position, a rearward portion of said cover top wall planar top surface portion overlaps an outer surface portion of said back wall, and wherein said bottom surface of said top wall includes a recess therein for providing clearance between said cover and said top edge of the back wall during movement between said opened and closed positions, whereby the space required for the operation of said cover between said opened and closed positions is minimized.

2. The container according to claim 1, wherein said mounting means includes a bracket having a vertical blade, and a pocket disposed in said back wall of said body, wherein said bracket is attached to a golf cart and said pocket receives said blade for securing said storage container on the golf cart.

3. The container according to claim 1, wherein the mounting means comprises an L-shaped bracket.

4. The container according to claim 1, wherein said recess is semi-cylindrical in shape.

5. The container according to claim 1, wherein said recess extends from adjacent a back wall of said cover to a midpoint of said top wall of said cover.

6. The container according to claim 1, wherein said handle is U-shaped and includes an elongated grip wherein said stowed position, said grip rests flush against said back wall and, alternatively, said front wall of said container.

7. The container according to claim 1, wherein said walls of said body include an internal channel for containing insulation.

8. The container according to claim 1, wherein said container includes detent means for securing said cover in said closed position.

9. The container according to claim 5, wherein said detent means includes a protrusion depending from said cover, said protrusion communicating with said container body for providing a resisting force against movement of said cover away from said closed position.

10. The container according to claim 1, wherein said first axis is disposed halfway between said second axis and said back wall.

11. A container comprising:

a box-shaped container body comprising a front wall, a back wall, opposing side walls, a bottom wall and an open top end;

a single, contiguous cover having a planar top surface portion and a bottom surface spaced apart from the planar top surface portion, the cover further including a pair of integrally formed opposing side flanges wherein each side flange overlaps one of said body side walls, each side flange being pivotably mounted to said side wall for movement about a first axis of rotation to rotate said cover over a top edge of the back wall between a closed position to enclose said entire open top end of the body, and an open position allowing access to said entire open top end, wherein the cover includes a recess on the bottom surface, the recess extending from adjacent a back wall of said cover to a midpoint of the bottom surface to provide clearance for said top edge of the back wall when moving said cover to the open position, the bottom surface further including a planar portion extending from said recess at the midpoint of the bottom surface to a front wall of the cover, and wherein said first axis of rotation is disposed between a horizontal midpoint of said side wall and said back wall such that in said open position, a rear portion of said cover overlaps an outer surface of said back wall.

12. A container according to claim 11, wherein said cover includes a latch.

13. A container according to claim 11, further comprising a U-shaped handle pivotally connected to said opposing side walls of the body at a horizontal midpoint thereof.

14. A container according to claim 11, wherein said first axis of rotation is disposed an equal distance from said back wall and said open top end of the container.

15. A container according to claim 11, further comprising a means for mounting said container to a golf cart.

16. A container according to claim 15, wherein said mounting means comprises a bracket having a vertical blade attachable to the golf cart and further wherein said container includes a back wall having a recess adapted to receive said vertical blade of the bracket to removably mount said container on the bracket.

17. A container according to claim 16, wherein said bracket is L-shaped whereby a horizontal portion of said L-shaped bracket supports said bottom wall of said container.

18. A container according to claim 11, wherein the walls of the body include an internal channel filled with insulation whereby said container functions as a cooler.

19. A storage container comprising:

a container body including a front wall, a back wall, a pair of opposing side walls, a bottom wall and an open top end, a single, contiguous cover including a top wall having a planar top surface portion spaced apart from a bottom surface, the bottom surface including a recess formed therein to provide clearance for a top edge of the back wall when moving the cover to an opened position, the cover further including a pair of integrally formed opposing side arms extending from said top wall, each of said arms overlapping a portion of one of said side walls and pivotally connected thereto for movement about a first axis of rotation between a closed position for enclosing said entire open top end, and an opened position in which the cover is rotated open such that the planar top surface portion of the cover is perpendicular to a plane formed across the open top end for allowing access to said entire open top end, a handle having a pair of legs pivotally connected to said side walls of said container body for movement about a second axis of rotation not associated with the cover, the handle rotatable about the second axis of rotation between a raised position for carrying said storage container and a stowed position for allowing access to said open top end, wherein said first axis of rotation is positioned between said second axis of rotation and said back wall, whereby the space required for the operation of said cover between said opened and closed positions is minimized.

* * * * *